US008115397B2

(12) United States Patent
Jonsson

(10) Patent No.: US 8,115,397 B2
(45) Date of Patent: Feb. 14, 2012

(54) POWER FAILURE REPORTING IN A NETWORKED LIGHT

(75) Inventor: Karl Jonsson, Rancho Santa Margarita, CA (US)

(73) Assignee: Greenwave Reality PTE, Ltd., Singapore (SG)

( * ) Notice: Subject to any disclaimer, the term of this patent is extended or adjusted under 35 U.S.C. 154(b) by 0 days.

(21) Appl. No.: 12/984,583

(22) Filed: Jan. 4, 2011

(65) Prior Publication Data

US 2011/0163668 A1 Jul. 7, 2011

(51) Int. Cl.
*H01J 1/60* (2006.01)

(52) U.S. Cl. ..... 315/129; 315/86; 315/307; 315/318

(58) Field of Classification Search ..... 315/86, 315/88, 90, 129, 291, 294, 297, 307, 312, 315/318
See application file for complete search history.

(56) References Cited

U.S. PATENT DOCUMENTS

| | | | | |
|---|---|---|---|---|
| 5,442,257 | A * | 8/1995 | Mitsumoto | 315/129 |
| 5,734,229 | A * | 3/1998 | Bavaro et al. | 315/86 |
| 6,900,595 | B2 * | 5/2005 | Cojocary | 315/86 |
| 8,013,545 | B2 * | 9/2011 | Jonsson | 315/318 |
| 2010/0327766 | A1 * | 12/2010 | Recker et al. | 315/291 |
| 2011/0140611 | A1 * | 6/2011 | Elek et al. | 315/130 |

* cited by examiner

*Primary Examiner* — Tung X Le
(74) *Attorney, Agent, or Firm* — Bruce A. Young

(57) ABSTRACT

Power is stored in a networked light allowing the networked light to send a message over the network providing information that the networked light is turning off if external power is no longer available.

20 Claims, 4 Drawing Sheets

POWER FAILURE REPORTING IN A NETWORKED LIGHT

BACKGROUND

1. Technical Field

The present subject matter relates to lighting. More specifically, it relates to a networked light.

2. Description of Related Art

In the past, most lighting systems used incandescent or florescent light bulbs for illumination. As light emitting diode (LED) technology improves, it is being used more and more for general illumination purposes. In many cases, LED based light bulbs are a direct replacement for a traditional incandescent or florescent light bulb and do not include any other functionality. In some cases, however, additional functionality is included within a lighting apparatus.

Providing home automation functionality using networking is well known in the art. Control of lighting and appliances can be accomplished using systems from many different companies such as X10, Insteon® and Echelon. Other home automation systems may utilize radio frequency networks using protocols such as IEEE 802.15.4 Zigbee or Z-Wave networking protocols.

Most buildings are constructed with wiring in the walls and ceilings carrying alternating current (AC) voltage from a central distribution point to the various outlets, appliances and lighting fixtures in the building. Some of the wiring circuits may include simple single-pole, single-throw wall switches or three-way switches for controlling the outlets, appliances and/or lighting fixtures on that circuit. Devices connected to these switched circuits may not be able to count on having power available, as the devices may be disconnected from power at any time by the switch on the circuit.

SUMMARY

A method for reporting a state of a networked light bulb includes storing energy in a networked lighting apparatus and detecting that an external power source has been disconnected from the networked lighting apparatus. A network message is sent from the networked lighting apparatus in response to the detection that the external power source has been disconnected from the networked lighting apparatus with the network message including data indicating that the networked lighting apparatus is turning off. The stored energy is sufficient to power at least a portion of the networked lighting apparatus for a period of time long enough to send the network message.

A lighting device including a light emitting diode (LED), a networked controller, power conversion circuitry, an energy storage device, and power detection circuitry may implement the method described above. The networked controller is configured to communicate over a network and control an on/off state of the LED. The power conversion circuitry is configured to receive power from an external power connection and provide power for the LED. The energy storage device is configured to store energy from the power conversion circuitry. The power detection circuitry is configured to monitor the external power connection and send a power fail indication to the networked controller if the external power connection stops providing power to the lighting device and the networked controller is configured to send a send a message over the network in response to the power fail indication while being powered by the energy storage device. The network message indicates that the lighting apparatus is entering an off state

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. They should not, however, be taken to limit the invention to the specific embodiment(s) described, but are for explanation and understanding only. In the drawings.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures and components have been described at a relatively high-level, without detail, in order to avoid unnecessarily obscuring aspects of the present concepts. A number of descriptive terms and phrases are used in describing the various embodiments of this disclosure. These descriptive terms and phrases are used to convey a generally agreed upon meaning to those skilled in the art unless a different definition is given in this specification. Some descriptive terms and phrases are presented in the following paragraphs for clarity.

The term "light emitting diode" or "LED" refers to a semiconductor device that emits light, whether visible, ultraviolet, or infrared, and whether coherent or incoherent. The term as used herein includes incoherent polymer-encased semiconductor devices marketed as "LEDs", whether of the conventional or super-radiant variety. The term as used herein also includes semiconductor laser diodes and diodes that are not polymer-encased. It also includes LEDs that include a phosphor or nanocrystals to change their spectral output. It can also include organic LEDs.

Reference now is made in detail to the examples illustrated in the accompanying drawings and discussed below.

Figure 1:
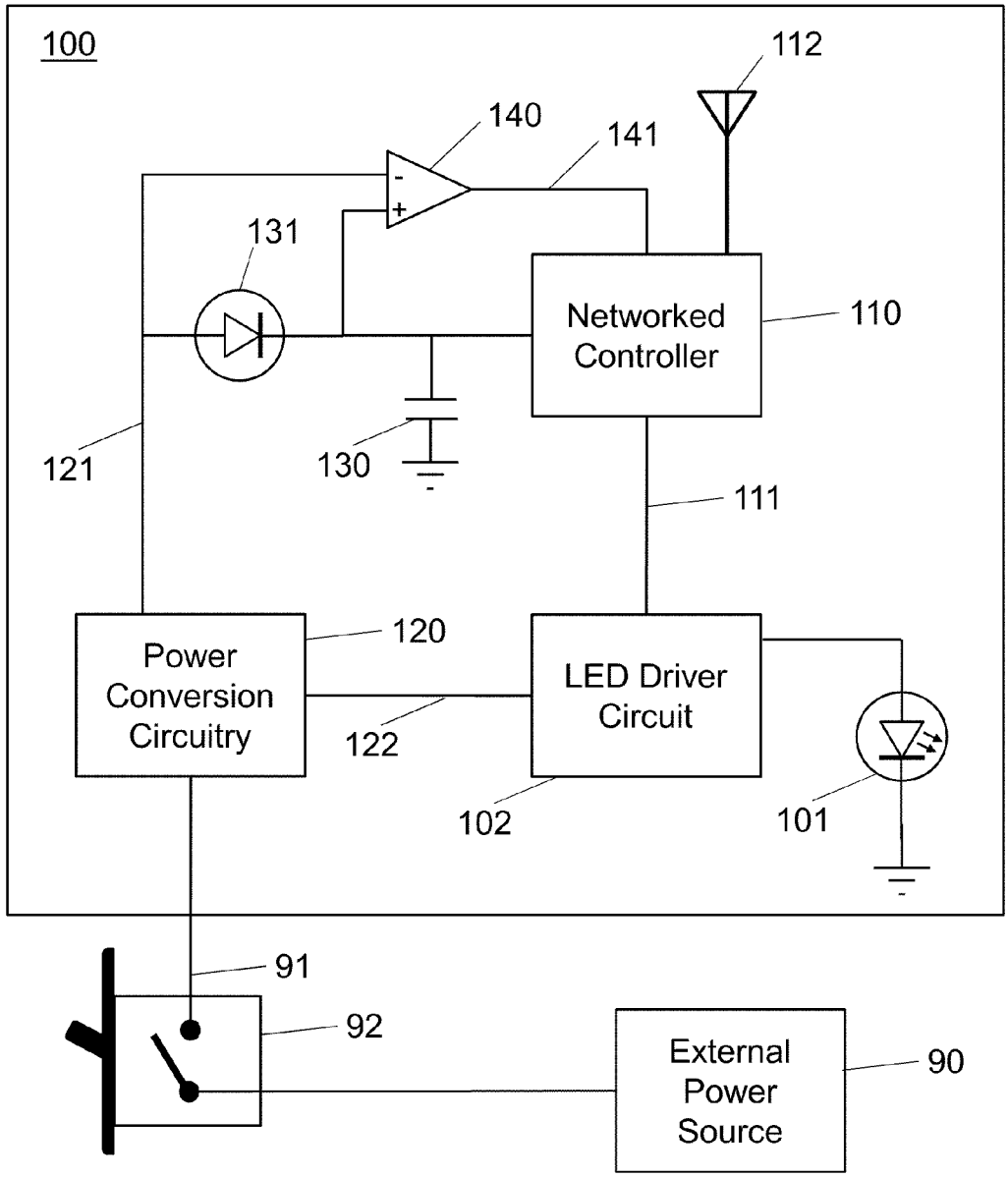
FIG. 1 shows a block diagram of an embodiment of a lighting apparatus.

FIG. 1 shows a block diagram of an embodiment of a lighting apparatus 100. An external power source 90 may be connected to the lighting apparatus 100 through a switch 92 to connection 91. The external power source may be any type of energy source including, a battery, a direct current (DC) voltage source, a solar panel, a fuel cell, or any other type of power source. In some embodiments, the external power source may be the AC power grid connected to the lighting apparatus 100 using an AC voltage circuit such as in a home or other structure. The AC voltage circuit may be switched using a standard wall switch (single-pole, single-throw), three-way wall switches (single-pole double-throw), or other type of manual or automated switch as the switch 92. Some embodiments of the lighting apparatus may be designed to be hard-wired into the AC voltage circuit while other embodiments may utilize a socket or other user accessible mechanism to allow for end-user installation of the lighting apparatus 100.

The lighting apparatus 100 may include power conversion circuitry 120 suitable for converting the power provided by the external power source 90 to the lighting apparatus 100 through the connection 91 to a type suitable for a particular embodiment. Various types of circuitry well known in the art may be used, depending on the embodiment, but in many embodiments, the power conversion circuitry 120 may convert commonly available AC power at about 110 root-mean-square volts (VAC) or about 220 VAC to one or more voltages of direct current (DC) power. In the embodiment shown in FIG. 1, the power conversion circuitry 120 provides two voltage outputs. One output 122 may be used to power the LED driver circuit 102 while the other output 121 may be used to provide power to the networked controller 110. In some embodiments a single DC output from the power conversion circuitry 120 may be used both to power the LED 101 and the networked controller 110 and other embodiments may have more than two power outputs and may include one output that is unchanged from the power received from the external power connection 91.

The LED driver circuitry 102 may be configured to provide power to one or more LEDs 101 to provide illumination. Any illumination level could be provided by the lighting apparatus 100, but to typically be considered a source for illumination the LED 101 may output at least the equivalent of a 5 watt incandescent bulb, or at least 25 lumens of luminous flux. The LED driver circuitry 102 may be an integrated circuit such as the NXP SSL2101 or similar parts from Texas Instruments or others.

Other embodiments may utilize some other type of light emitting device instead of using one or more LEDs. Some embodiments may use a fluorescent light such as a coiled fluorescent light (CFL) or a fluorescent tube, an incandescent light, an arc light, a plasma light, or other type of light emitting element in addition to, or instead of, one or more LEDs.

The second output 121 of the power conversion circuitry 120 may be coupled to an energy storage device, such as a capacitor 130 in the embodiment shown, a rechargeable battery or other form of energy storage device in other embodiments. The capacitor 130 may be a single capacitor, a supercapacitor, or several individual capacitors and/or supercapacitors in parallel or other circuit configuration. In some embodiments, the power conversion circuitry 120 is coupled to the capacitor 130 through a diode 131 to keep energy from draining back from the capacitor 130 into the power conversion circuitry 120 if the voltage on output 121 is lower than the voltage on the capacitor 130. The voltage on the capacitor 130 may be used to provide power to the networked controller 110.

Power detection circuitry such as the comparator 140 may be provided to assert a power fail indication 141 to the networked controller 110 if the external power source 90 is not providing power to the lighting apparatus 100. The power detection circuitry 140 may monitor the external power connection 91 in various ways in various embodiments, either directly or indirectly. In some embodiments, the power detection circuitry 140 may be integrated into the power conversion circuitry 120 and other embodiments may integrate the power detection circuitry directly into the networked controller. In other embodiments, the power detection circuitry 140 may directly monitor the external power connection 91, while in other embodiments the power detection circuitry 140 may monitor an output of the power conversion circuitry 120. Any method may be used to directly or indirectly monitor the external power connection 91 to detect if the external power connection 91 stops providing power to the lighting apparatus. In some embodiments, it may be determined that the external power connection 91 has stopped providing power if the voltage and/or current levels on the external power connection 91, or an output of the power conversion circuitry 120, drop below a predetermined level, even though there may still be some power entering the lighting apparatus 100 through the external power connection 91. In FIG. 1, the comparator 140 compares the voltage of the capacitor 130 to the voltage output 121 of the power conversion circuitry 120 and asserts the power fail indication 141 if the voltage from the power conversion circuitry 120 is lower than the voltage of the capacitor 130 by a predetermined amount.

The networked controller 110 may include a microprocessor, memory and a network interface or may be some other configuration of circuitry. The microprocessor may be running a computer program configured to take specific actions in response to various input conditions. Any type of network may be supported but in many embodiments, a wireless network using radio frequency communication may be used such as 802.11 Wi-Fi, 802.15.4 Zigbee or Z-Wave. If a wireless network using radio frequency communication is used, the antenna 112 may be included. Some embodiments may use separate integrated circuits for the microprocessor, memory and/or network interface, but in many embodiments, multiple parts of the networked controller 110 may be integrated into a single integrated circuit. In one embodiment utilizing a IEEE 802.15.4 Zigbee networking, the microprocessor, memory and Zigbee wireless network interface are integrated into a single integrated circuit such as the CC2539 from Texas Instruments. Another embodiment utilizing Z-Wave networking may use a Zensys ZM3102N module based on the Zensys ZW0301 integrated circuit as an integrated networked controller 110. The networked controller 110 may control various aspects of the operation of the lighting apparatus 100, including, but not limited to, an on/off state of the LED 101. The networked controller 110 may receive and/or send messages over the network related to the on/off state or other parameters of the lighting apparatus 100. The networked controller 110 may have a connection 111 to the LED driver circuit to allow the networked controller 110 to set the on/off state of the LED 101.

If the external power source 90 stops sending power to the lighting apparatus 100 through the external power connection 91 due to a power failure, disconnecting the lighting apparatus 100 from the external power connection 91, switching the circuit between the external power source 90 and the external power connection 91 using switch 92, or any other mechanism, the power detection circuitry 140 may detect that the external power connection 91 has stopped supplying power to the lighting apparatus 100 and assert the power fail indication 141. The power fail indication 141 may be a single electrical connection with a binary state, a serial bus message, a parallel bus message, or other mechanism known in the art for communicating between two circuit elements. The networked controller 110 may receive the power fail indication 141 from the power detection circuitry 140 and send a network message over the network indicating that the lighting apparatus 100 is turning off.

Because the external power connection 91 may not be providing power at the time that the network message is sent, the capacitor 130 may provide power to the networked controller 110 during the time it is sending the network message indicating that the lighting apparatus 100 is turning off. In some embodiments, the networked controller 110 may send more than one network message indicating that the lighting apparatus 100 is turning off. The networked controller 110 may repeat the same message multiple times or may send different messages providing information about turning off the lighting apparatus 100. In some embodiments, the networked controller 110 may repeat the network message continually until the capacitor 130 is no longer able to provide the power needed to send network messages.

The size of the capacitor 130 may be chosen so that the capacitor 130 is able to provide power for a long enough time period to ensure that the network message may be successfully sent. In one embodiment, the capacitor 130 may be charged to 3.5 volts (V) during normal operation and the networked controller 110 may be specified to operate with a voltage input ranging from 2.0V to 3.5V and draw a maximum of 30 mA if the network is active. It may be determined that after a power fail indication 141 is received by the networked controller 110, the networked controller 110 may take up to one second to successfully send at least one network message that indicates the lighting apparatus 100 is turning off. Although the current drawn by the networked controller 110 may not be linear with voltage like a resistor would be, the networked controller 110 can be conservatively modeled as a resistor with a value that would have the same current flow as the networked controller 110 at the low end of the operating voltage range of 2.0V. The equation for a resistance is R=V/I so a resistance value of 66 ohms (Ω)≈2.0/0.03 may be used to model the networked controller. It is well known that the voltage of an capacitor discharging through a resistor is $V(t)=V_0*(1-e^{-t/RC})$, so substituting the values shown above, $2.0=3.5*(1-e^{-1/66*C})$ and solving for the capacitance $C=-1/66*\ln(1-2/3.5)$ or C=0.017882 F. Rounding up to the nearest standard capacitance value would give a value of 18,000 μF for the capacitor 130 to provide at least one second of power to the networked controller 110 after external power 90 is disconnected.

Figures 2A, 2B:
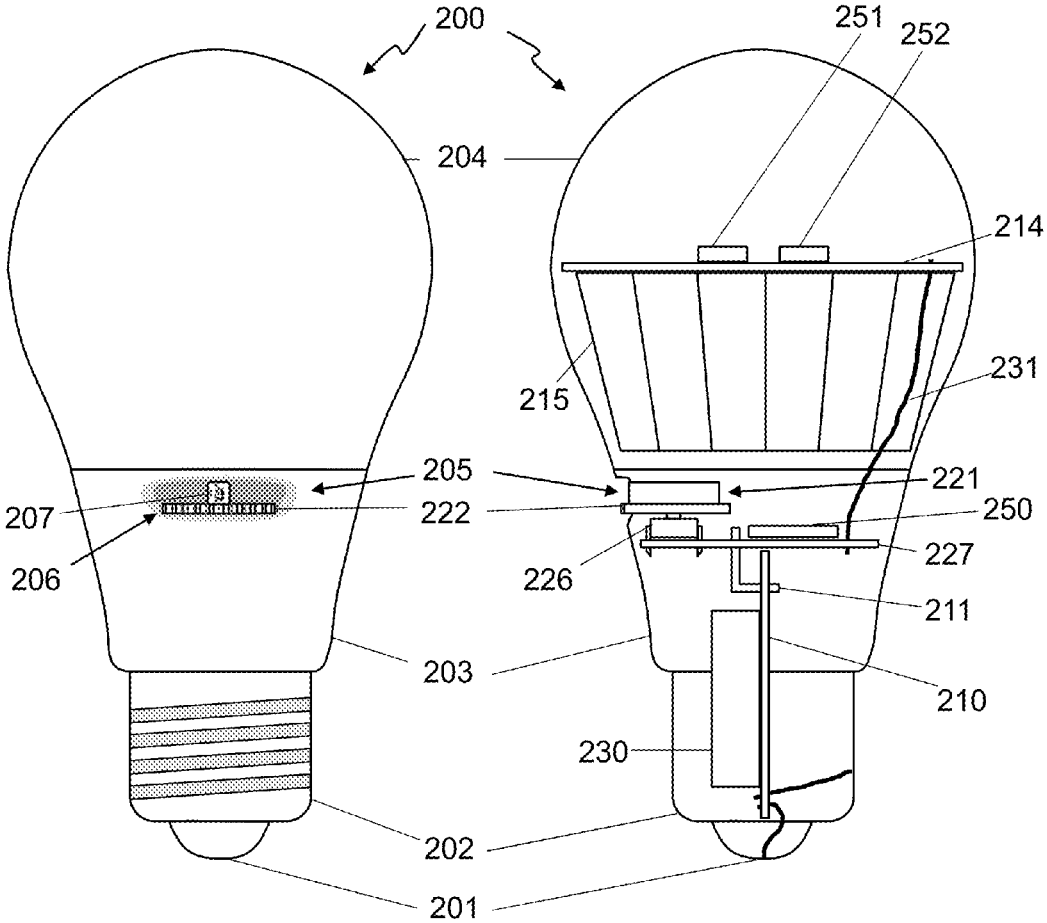
FIG. 2A is an elevational view and FIG. 2B is a cross-sectional view of an embodiment of a light bulb.

FIG. 2A is an elevational view (with inner structure not shown) and FIG. 2B is a cross-sectional view of an embodiment of a light bulb 200. Wall thicknesses of some mechanical parts are not shown to simplify the drawing. In this embodiment a networked light bulb 200 is shown but other embodiments could be a light fixture with embedded LEDs or any other sort of light emitting apparatus. The networked light bulb 200 of this embodiment may have an Edison screw base with a power contact 201 and a neutral contact 202, a middle housing 203 and an outer bulb 204. Each section 201, 202, 203, 204 may be made of a single piece of material or be assembled from multiple component pieces. In some embodiments, one fabricated part may provide for multiple sections 201, 202, 203, 204. The outer bulb 204 may be at least partially transparent and may have ventilation openings in some embodiments, but the other sections 201, 202, 203 can be any color or transparency and be made from any suitable material. The middle housing 203 may have an indentation 205 with a slot 206 and an aperture 207. A color wheel 221 useful for providing configuration information from the user may be attached to the shaft of rotary switch 226 which may be mounted on a printed circuit board 227. The printed circuit board 227 may also have networked controller 250 mounted on it. An energy storage device such as a capacitor or rechargeable battery may also be mounted on printed circuit board 227. The printed circuit board 227 may be mounted horizontally so that the edge 222 of the color wheel 221 may protrude through the slot 206 of the middle housing 203. This may allow the user to apply a rotational force to the color wheel 221 to change settings.

In the embodiment shown, a second printed circuit board 210 may be mounted vertically in the base of the networked light bulb 200. The second printed circuit board 210 may contain the power conversion circuitry 230 and the power detection circuitry. In some embodiments, the LED driver circuitry may also be mounted on the second printed circuit board 210. A board-to-board connection 211 may be provided to connect selected electrical signals between the two printed circuit boards 227, 210. Control signals, such as the power fail indication, and the power supply connections may be among the signals included on the board-to-board connection 211. A third printed circuit board 214 may have LEDs 251, 252 mounted on it and may be backed by a heat sink 215 to cool the LEDs 251, 252. In some embodiments the third printed circuit board 214 with the LEDs 251, 252 may be replaced by a single multi-die LED package. A cable 231 may carry power from the LED driver circuitry (which may be mounted on either the printed circuit board 227 or the second printed circuit board 210) to the LEDs 251, 252, cabling from the first printed circuit board 227 to the third printed circuit board 214, or, in some embodiments the cable 231 may connect to the second printed circuit board 210 directly to the third printed circuit board 214 instead of passing the signals through the printed circuit board 227.

The light bulb 200 may be of any size or shape. It may be a component to be used in a light fixture or it may be designed as a stand-alone light fixture to be directly installed into a building or other structure or used as a stand-along lamp. In some embodiments, the light bulb may be designed to be substantially the same size and shape as a standard incandescent light bulb. A light bulb designed to be compliant with an incandescent light bulb standard published by the National Electrical Manufacturer's Association (NEMA), American National Standards Institute (ANSI), International Standards Organization (ISO) or other standards bodies may be considered to be substantially the same size and shape as a standard incandescent light bulb. Although there are far too many standard incandescent bulb sizes and shapes to list here, such standard incandescent light bulbs include, but are not limited to, "A" type bulbous shaped general illumination bulbs such as an A19 or A21 bulb with an E26 or E27, or other sizes of Edison bases, decorative type candle (B), twisted candle, bent-tip candle (CA & BA), fancy round (P) and globe (G) type bulbs with various types of bases including Edison bases of various sizes and bayonet type bases. Other embodiments may replicate the size and shape of reflector (R), flood (FL), elliptical reflector (ER) and Parabolic aluminized reflector (PAR) type bulbs, including but not limited to PAR30 and PAR38 bulbs with E26, E27, or other sizes of Edison bases. In other cases, the light bulb may replicate the size and shape of a standard bulb used in an automobile application, most of which utilize some type of bayonet base. Other embodiments may be made to match halogen or other types of bulbs with bi-pin or other types of bases and various different shapes. In some cases the light bulb 200 may be designed for new applications and may have a new and unique size, shape and electrical connection. Other embodiments may be a light fixture, a stand-alone lamp, or other light emitting apparatus.

Figure 3:
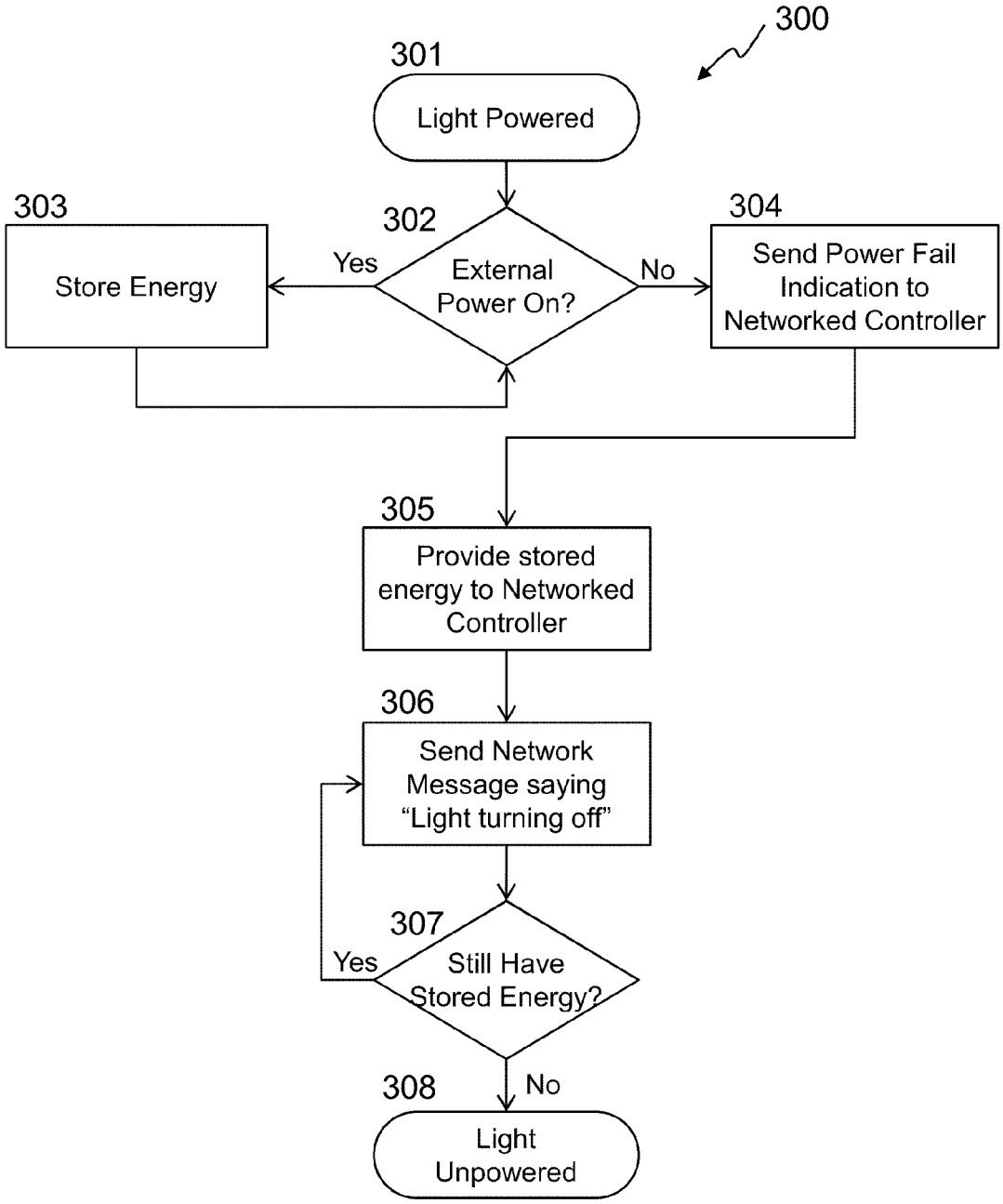
FIG. 3 is a flow chart of an embodiment of a method of power fail reporting in a networked light.

FIG. 3 is a flow chart 300 of an embodiment of a method of power fail reporting in a networked light. The light is provided power at block 301 and the external power connection is monitored at block 302. As long as power is being provided by the external power connection, energy is stored in the energy storage device at block 303. If it is detected that the external power connection is no longer providing power to the networked light at block 302, a power fail indication may be sent to the networked controller at block 304. Because power is no longer being provided by the external power connection, the energy storage device provides power to the networked controller starting at block 305. The network controller sends a message over the network indicating that the light has been turned off at block 306. The energy storage device is checked at block 307, and in some embodiments, block 306 is repeated, sending the network message multiple times at block 307, until the energy storage device no longer has enough energy to power the networked controller and the light is unpowered at block 308.

Figure 4:
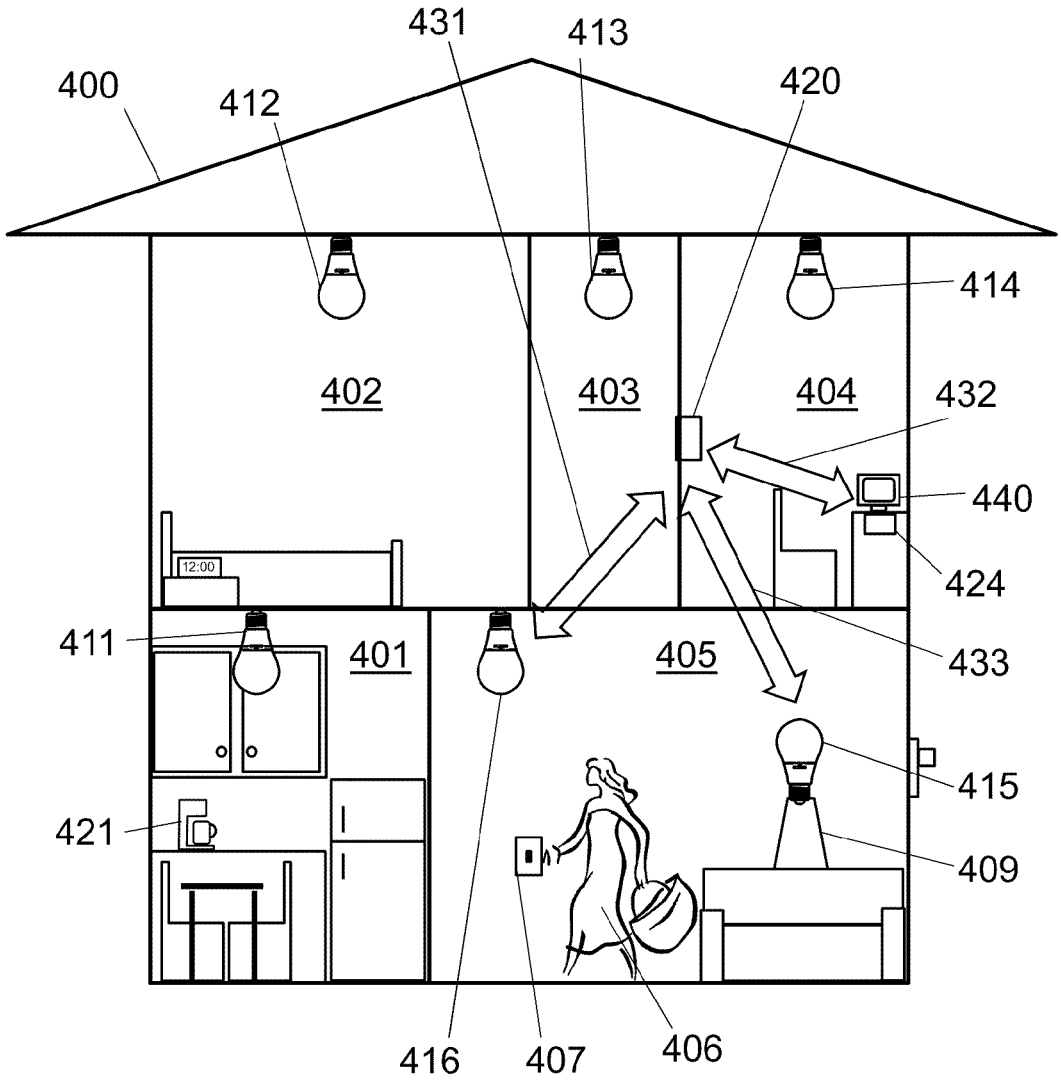
FIG. 4 shows a stylized view of a networked home.

FIG. 4 shows a stylized view of a networked home 400. In the embodiment shown, networked devices communicate over a wireless mesh network such as Z-wave or Zigbee (IEEE 802.15.4). Other wireless networks such as Wi-Fi (IEEE 802.11) might be used in a different embodiment. This exemplary home 400 has five rooms. The kitchen 401 has a networked light fixture 411 and a networked coffee pot 421. The bedroom 402 has a networked light fixture 412, and the hallway 403 has a networked light bulb 413. The home office 404 has a networked light bulb 414, a network controller 420, and a home computer 440 connected to a network gateway 424. The living room 405 has two networked light bulbs 415, 416. Networked light bulb 416 may be on a switched AC circuit controlled by a conventional wall switch 407. Networked light bulb 415 may be in a lamp 409 that is plugged into a standard unswitched wall outlet. Homeowner 406 decides to turn out the lights in the living room 405 and turns off the switch 407.

Switch 407 disconnects the light bulb 416 from its external power source, the AC grid, so that its external power connection is no longer providing power to the light bulb 416. The power detection circuitry in the light bulb 416 may detect that the external power connection is no longer providing power to the light bulb and may send a power fail indication to the networked controller in the light bulb 416. An energy storage device in the light bulb 416 may provide power to the networked controller in the light bulb 416 for a long enough time for the networked controller in the light bulb 416 to send a message indicating that the light bulb 416 is turning off. The message may be sent on the wireless mesh network over link 431 to the network controller 420 which may relay the message over network link 432 through the network gateway 424 to the home computer 440 which may be running a home automation program. The home automation program running on the computer 440 may have been previously programmed to respond if the light bulb 416 in the living room has been turned off by turning off other lights in the living room 405. The computer 440 then sends a message through the network gateway 424, network link 432, the network controller 420 and network link 433 to the network light bulb 415 in the living room 405, telling the light bulb 415 to turn off. A wide variety of actions may be possible in response to the light bulb 416 being turned off by switch 407 including, but not limited to, starting the coffee pot 421, turning on light bulb 411, turning other networked light bulbs 412, 413, 414 on or off, changing thermostat settings, and/or changing the operating state of any other networked device on the home network.

Unless otherwise indicated, all numbers expressing quantities of elements, optical characteristic properties, and so forth used in the specification and claims are to be understood as being modified in all instances by the term "about." Accordingly, unless indicated to the contrary, the numerical parameters set forth in the preceeding specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques.

As used in this specification and the appended claims, the singular forms "a", "an", and "the" include plural referents unless the content clearly dictates otherwise. Thus, for example, reference to an element described as "an LED" may refer to a single LED, two LEDs or any other number of LEDs. As used in this specification and the appended claims, the term "or" is generally employed in its sense including "and/or" unless the content clearly dictates otherwise. As used herein, the term "coupled" includes direct and indirect connections. Moreover, where first and second devices are coupled, intervening devices including active devices may be located there between. Any element in a claim that does not explicitly state "means for" performing a specified function, or "step for" performing a specified function, is not to be interpreted as a "means" or "step" clause as specified in 35 U.S.C. §112, ¶ 6.

The flowchart and/or block diagrams in the figures help to illustrate the architecture, functionality, and operation of possible implementations of systems, methods and computer program products of various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The description of the various embodiments provided above is illustrative in nature and is not intended to limit the invention, its application, or uses. Thus, variations that do not depart from the gist of the invention are intended to be within the scope of the embodiments of the present invention. Such variations are not to be regarded as a departure from the intended scope of the present invention.

What is claimed is:

1. A method for reporting a state of a networked lighting apparatus, the method comprising:

storing energy in the networked lighting apparatus;

detecting that an external power source has stopped providing power to the networked lighting apparatus; and sending a network message from the networked lighting apparatus in response to said detection that the external power source has stopped providing power to the networked lighting apparatus, said network message comprising data indicating that the networked lighting apparatus is entering an off state;

wherein said stored energy is sufficient to power at least a portion of the networked lighting apparatus for a period of time long enough to send said network message.

2. The method of claim 1 further comprising:

turning off a light emitting element, wherein the light emitting element is turned off before said network message is sent.

3. The method of claim 1 wherein said network message is sent more than once.

4. The method of claim 1 wherein said network message is sent over a radio frequency network.

5. The method of claim 4 wherein said radio frequency network utilizes a Zigbee protocol.

6. The method of claim 1 further comprising:

changing a state of another networked device in response to said network message.

7. A lighting apparatus comprising:

at least one light emitting element;

a networked controller configured to communicate over a network and to control an on/off state of the at least one light emitting element;

power conversion circuitry configured to receive power from an external power connection and provide power for the at least one light emitting element;

an energy storage device configured to store energy from the power conversion circuitry; and power detection circuitry configured to send a power fail indication to the networked controller if the external power connection stops providing power to the lighting apparatus;

wherein the networked controller is configured to send a message over the network in response to the power fail indication while being powered by the energy storage device, said network message indicating that the lighting apparatus is entering an off state.

8. The lighting apparatus of claim 7 wherein the at least one light emitting element comprises a light emitting diode (LED).

9. The lighting apparatus of claim 7 wherein the energy storage device comprises one or more capacitors.

10. The lighting apparatus of claim 7 wherein the energy storage device comprises a rechargeable battery.

11. The lighting apparatus of claim 7 wherein the network controller is further configured to turn off the at least one light emitting element before said network message is sent.

12. The lighting apparatus of claim 7 wherein said network message is sent over a radio frequency network.

13. The lighting apparatus of claim 12 wherein said radio frequency network utilizes a Zigbee protocol.

14. A light bulb comprising:

at least one light emitting element;

a networked controller configured to communicate over a network and to control an on/off state of the at least one light emitting element;

power conversion circuitry configured to receive power from an external power connection through a base and provide power for the at least one light emitting element;

an energy storage device configured to store power from the power conversion circuitry;

power detection circuitry configured to send a power fail indication to the networked controller if the external power connection stops providing power to the light bulb; and a shell connected to the base and containing the at least one light emitting element, the networked controller, the power conversion circuitry, the energy storage device and the power detection circuitry, said shell at least partially transparent and substantially the same size and shape as a typical incandescent light bulb;

wherein the networked controller is configured to send a message over the network in response to the power fail indication while being powered by the energy storage device, said network message indicating that the light bulb is entering an off state.

15. The light bulb of claim 14 wherein the at least one light emitting element comprises a light emitting diode (LED).

16. The light bulb of claim 14 wherein the energy storage device comprises one or more capacitors.

17. The light bulb of claim 14 wherein the energy storage device comprises a rechargeable battery.

18. The light bulb of claim 14 wherein the network controller is further configured to turn off the at least one LED, wherein the at least one light emitting element is turned off before said network message is sent.

19. The light bulb of claim 14 wherein said network message is sent over a radio frequency network.

20. The light bulb of claim 19 wherein said radio frequency network utilizes a Zigbee protocol.

* * * * *